US005228222A

United States Patent [19]

Holloway et al.

[11] Patent Number: 5,228,222

[45] Date of Patent: Jul. 20, 1993

[54] DIGGING AND PROPOLSION UNIT FOR A TRENCHING APPARATUS

[75] Inventors: Randy J. Holloway; Donnie W. Hicks, both of Lubbock, Tex.

[73] Assignee: Eagle-Picher Industries, Inc., Cincinnati, Ohio

[21] Appl. No.: 931,045

[22] Filed: Aug. 17, 1992

[51] Int. Cl.[5] ..... E02F 5/06

[52] U.S. Cl. ..... 37/357; 37/353; 37/347; 37/464

[58] Field of Search ..... 37/87, 86, 83, 80 R, 37/191 A, 191 R

[56] References Cited

U.S. PATENT DOCUMENTS

| | | | |
|---|---|---|---|
| 3,209,472 | 10/1965 | Nickolaev et al. | 37/87 X |
| 3,951,459 | 4/1976 | Honeycutt, Jr. | 37/87 X |
| 4,277,898 | 7/1981 | Flippin | 37/86 |
| 4,716,665 | 1/1988 | Johnson et al. | 37/191 A X |
| 4,861,199 | 8/1989 | Hackmack | 37/86 X |
| 4,871,281 | 10/1989 | Justice | 37/83 X |
| 4,893,464 | 1/1990 | Thuerman | 37/86 X |
| 5,113,609 | 5/1992 | Camilleri | 37/191 A X |

*Primary Examiner*—Dennis L. Taylor
*Assistant Examiner*—J. Russell McBee
*Attorney, Agent, or Firm*—Wood, Herron & Evans

[57] ABSTRACT

A trenching apparatus having a digger arm operative to form a trench along a trench line includes a lower end which mounts a digging and propulsion unit having an upper and lower group of sprockets which are vertically spaced from one another and carry chains having digger teeth mounted thereto. Structure is provided to increase the relative spacing between the upper and lower sprockets, while the chains remain in engagement therewith to increase tension in the chains as they wear and a number of scraper blades are mounted in position relative to the sprockets and the shafts which carry them to prevent the buildup of soil, concrete, rocks or other foreign material thereon and thus ensure smooth operation of the digging and propulsion unit.

21 Claims, 5 Drawing Sheets

DIGGING AND PROPOLSION UNIT FOR A TRENCHING APPARATUS

FIELD OF THE INVENTION

This invention relates to apparatus for forming trenches, and, more particularly, to an apparatus for digging a longitudinally extending trench suitable for the formation of an in-ground retaining wall at an excavation site which includes a digger arm carrying a digger and propulsion unit at its lower end operative to initially dig downwardly from the ground surface to trench depth and then propel the lower end of the digger arm along the trench line.

BACKGROUND OF THE INVENTION

The erection of above-ground structures, particularly in relatively sandy soil, often requires the formation of in-ground retaining walls for use as a load-bearing foundation or as a barrier to prevent the collapse of soil into the excavated area. Where such excavations are made adjacent an existing structure, the retaining wall along the excavation line adjacent the existing structure is necessary to resist soil pressures established beneath the adjoining structure. If no retaining wall is formed, the soil beneath the adjoining structure can collapse outwardly into the excavation site and/or damage the existing structure. In addition to retention of soil, retaining walls of this type are often constructed to block the flow of ground water into the excavated area.

A number of methods have been used to form retaining walls around an excavation site where adjacent structures adjoin such a site. One method has been to employ piles formed of wood or steel which are driven along the excavation line to form the retaining wall. Alternatively, a row of bored holes are formed along the excavation line which receive reinforced concrete piles to form the retaining wall. Both of these methods produce retaining walls which are not water-tight and which may require substantial horizontal strengthening to maintain the desired alignment along the excavation line.

Trenching apparatus such as disclosed in U.S. Pat. No. 4,843,742 to Camilleri have been proposed as an alternative to the methods and apparatus of forming retaining walls mentioned above. In trenching apparatus of this type, a supporting base capable of being moved in a longitudinal direction along a trench line carries an elongated digger arm supported on one side thereof by a boom structure. The support base is drivingly connected to skids or track assemblies of the type employed in conventional bulldozers or other excavation equipment which are effective to move the support base and digger arm along the trench line to form a trench of the desired depth. Concrete is poured into the trench in which appropriate reinforcement bars have been inserted immediately behind the moving trenching apparatus. In this manner, an essentially continuously formed, reinforced concrete retaining wall is provided a the excavation site.

Located at the lower end of the digger arm of the trenching apparatus disclosed in the 4,843,742 Camilleri patent is a digging and propulsion unit. This unit is initially placed atop the ground along the trench line and is operated to dig downwardly with the digger arm into the soil to the desired depth of the trench. As the boom structure mounted to the support base moves the upper end of the digger arm along the trench line, the digging and propulsion unit located below ground propels the lower end of the digger arm within the trench by operation of digger teeth carried by drive chains.

One problem with the digging and propulsion units of the type described in U.S. Pat. No. 4,843,742 is the loss of tension in the chains thereof as a result of wear. As the chains loosen, they do not effectively propel the lower end of the digging arm. To restore the proper tension to the chains associated with the digging and propulsion unit, the digger arm must be withdrawn from the trench, the worn chain(s) removed, and new chains installed. Such a procedure is inefficient an time-consuming.

A second problem with digging and propulsion units of the type disclosed in U.S. Pat. No. 4,843,742 is the accumulation of digging debris on the sprockets and shafts within the digging and propulsion unit which carry and drive the chains. Dirt, clay, concrete, sand, rocks and other materials tend to adhere to the hubs of the sprockets within the digging and propulsion unit and interfere with the travel of the digging chain about the sprocket and/or rotation of the sprocket. Periodically, the digger arm must be lifted out of the trench and workmen must use implements to remove the debris from the sprockets, shafts and chains. This procedure is labor intensive, time-consuming and adds expense to the cost of erecting the retaining wall.

A third problem with digging and propulsion units of the type disclosed in U.S. Pat. No. 4,843,742 is the rapid wear of the teeth or tips mounted to the chain(s) which dig downwardly to the initial trench depth, and then propel the lower end of the digging arm. Particularly in rocky or compacted soil, such as clay, these tips tend to wear after a short period of time requiring replacement of the individual tips or the entire chain.

SUMMARY OF THE INVENTION

It is therefore among the objectives of this invention to provide a digging and propulsion unit for a trenching apparatus that digs a longitudinally extending trench along a trench line, which substantially reduces the need for replacement of chains in the course of digging a trench, which reduces the accumulation of digging debris about the sprockets, shafts and chains of the digging and propulsion unit, and which digs effectively in rocky and compacted soils.

These objectives are accomplished in a trenching apparatus having a base support which mounts a boom structure connected to the upper end of a digger arm operative to form a trench alongside the base support following a trench line. The lower end of the digger arm mounts a digging and propulsion unit including an upper and lower group of sprockets which are vertically spaced from one another and carry chains having digger teeth mounted thereto. Structure is provided to increase the relative spacing between the upper and lower sprockets, while the chains remain in engagement therewith, to increase tension in the chains as they wear. In addition, a number of scraper blades are mounted in position relative to the sprockets and the shafts which carry them to prevent the buildup of soil, concrete, rocks or other foreign material thereon and thus ensure smooth operation of the digging and propulsion unit.

In the presently preferred embodiment, the digging and propulsion unit includes a frame which carries a drive sprocket drivingly connected to the output of a motor, and a driven sprocket fixed to an upper shaft rotatably mounted to the frame. An endless chain extends between the drive sprocket and the driven sprocket to rotate the driven sprocket, and, in turn, the upper shaft, relative to the frame. The upper shaft also mounts a pair of upper sprockets, axially spaced from one another on either side of the driven sprocket, which rotate with the upper shaft and driven sprocket.

The bottom portion of the digging and propulsion unit includes an adjustment plate which is slidably mounted to the frame so that it is movable upwardly and downwardly relative to the upper shaft and upper sprockets. The adjustment plate fixedly mounts a first lower shaft at a forward end thereof, and a second lower shaft at its rearward end which are spaced approximately equidistant from the upper shaft. Each of the first and second lower shafts mounts a first lower sprocket at one end which align with one of the upper sprockets, and a second lower sprocket at the other end which align with the other of the upper sprockets. A first endless chain extends around the two first lower sprockets and one of the upper sprockets, and a second endless chain extends around each of the second lower sprockets and the other upper sprocket. Additionally, each of the first and second lower shafts mounts a central sprocket which carry a central, endless chain therebetween.

To adjust tension within the first and second chains as they wear, bolts connected between the adjustment plate and frame are loosened and the adjustment plate, together with the first and second shafts it carries, move downwardly as a unit relative to the upper shaft and upper sprockets along slots formed in the adjustment plate. The corresponding increase in the distance between the upper shaft and lower shafts increases the tension in the first and second endless chains. The bolts are then retightened to secure the adjustment plate at its new position relative to the digging arm frame. Preferably, a tension bar is mounted to the digging arm frame in position to engage the upper run of the central chain so that when the adjustment plate is dropped, the tension bar contacts and tensions the central chain about the center sprockets.

Another aspect of this invention is directed to preventing the buildup of digging debris such as dirt, clay, concrete, sand, rocks, etc. on the sprockets and shafts described above. In the presently preferred embodiment, scraper arms or blades are mounted at one end to the digger arm frame and have a second end which extends proximate to the hub of each sprocket. The second end of these scraper arms break up and/or remove the accumulated soil and other debris around the hub of the sprockets to prevent the interference of this debris with the chain travel about the sprockets.

In yet another aspect of the invention, each of the endless chains herein is provided with high profile digging teeth, preferably constructed from a carbide material. The teeth associated with adjacent chain links are staggered to provide more effective soil breaking action so that the digging and propulsion unit can efficiently dig downwardly to the desired trench depth and then propel the bottom of the digger arm along the trench line.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
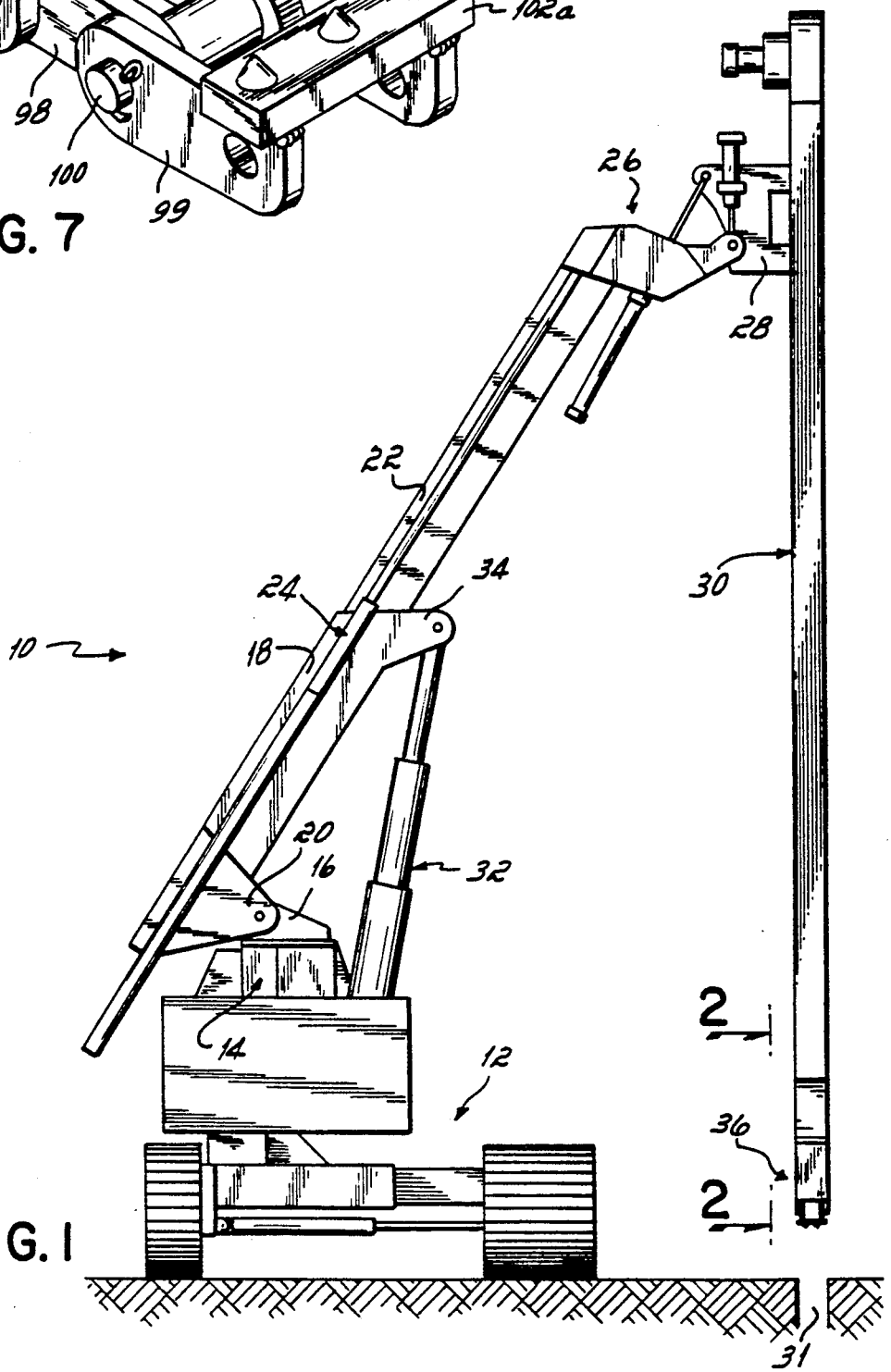
FIG. 1 is a schematic view of the trenching apparatus including the digging and propulsion unit of this invention.

Referring now to FIG. 1, the apparatus 10 comprises a support base 12 which mounts a fixed hitch 14 connected to a pivotal hinge 16. An outer boom 18 is pivotally mounted to the hinge 16 by bracket 20 and this outer boom 18 slidably receives an inner boom 22. One end of the inner boom 22 is connected to a boom extension cylinder 24 which mounts a digger arm manipulator head 26 having a bracket 28 carrying a digger arm 30. A lift cylinder 32 is connected by a bracket 34 to the outer boom 18 and is effective to angularly raise and lower the outer boom 18, which, in turn, raises and lowers the digger arm. After digging downwardly from ground level to the desired trench depth, the upper end of the digger arm 30 is propelled along a trench line by the support base 12 acting through the boom structure against the top end of the digger arm 30 and the lower end of the digger arm 30 is propelled by a digging and propulsion unit 36 located at the bottom end of the digger arm 30, below ground, as discussed in detail below. The foregoing construction of apparatus 10 forms no part of this invention of itself, and is therefore discussed only briefly herein for purposes of defining the overall construction of apparatus 10.

With reference to FIGS. 2–7, the digging and propulsion unit 36 is illustrated in detail. The purpose of the digging and propulsion unit 36 is to assist the digger arm 30 in initially digging downwardly from ground level to the desired trench depth, and to thereafter propel the bottom portion of the digger arm 30 along the trench line. The digging and propulsion unit 36 of this invention includes structure for adjusting the tension of chains associated with its drive mechanism, and scraper means for removing dirt, clay, concrete, sand, rocks or other foreign materials from such drive mechanisms.

Figure 2:
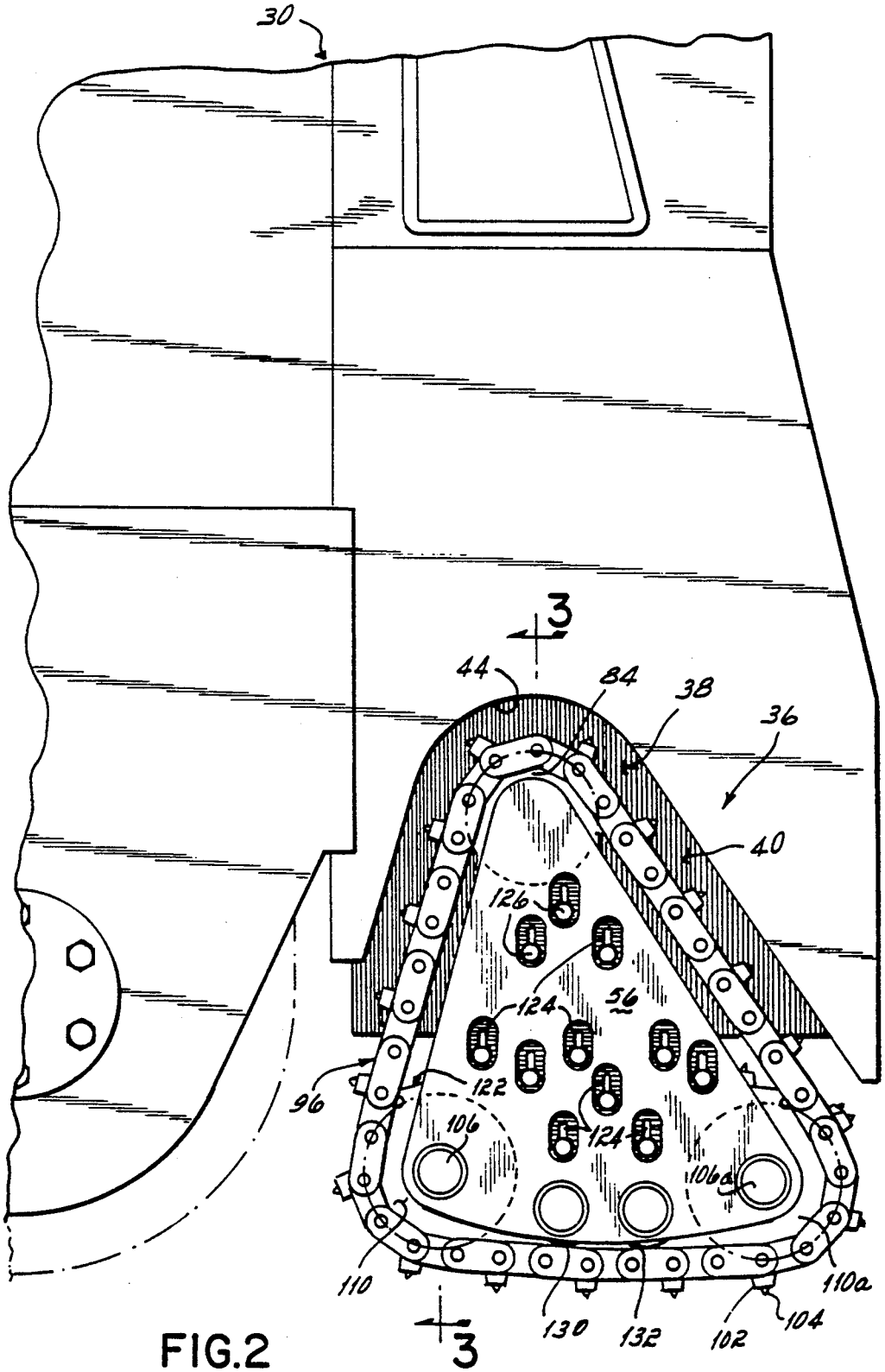
FIG. 2 is an elevational view of a portion of a digging and propulsion unit located at the lower end of the digging arm as seen on line 2—2 of FIG. 1.
Figure 3:
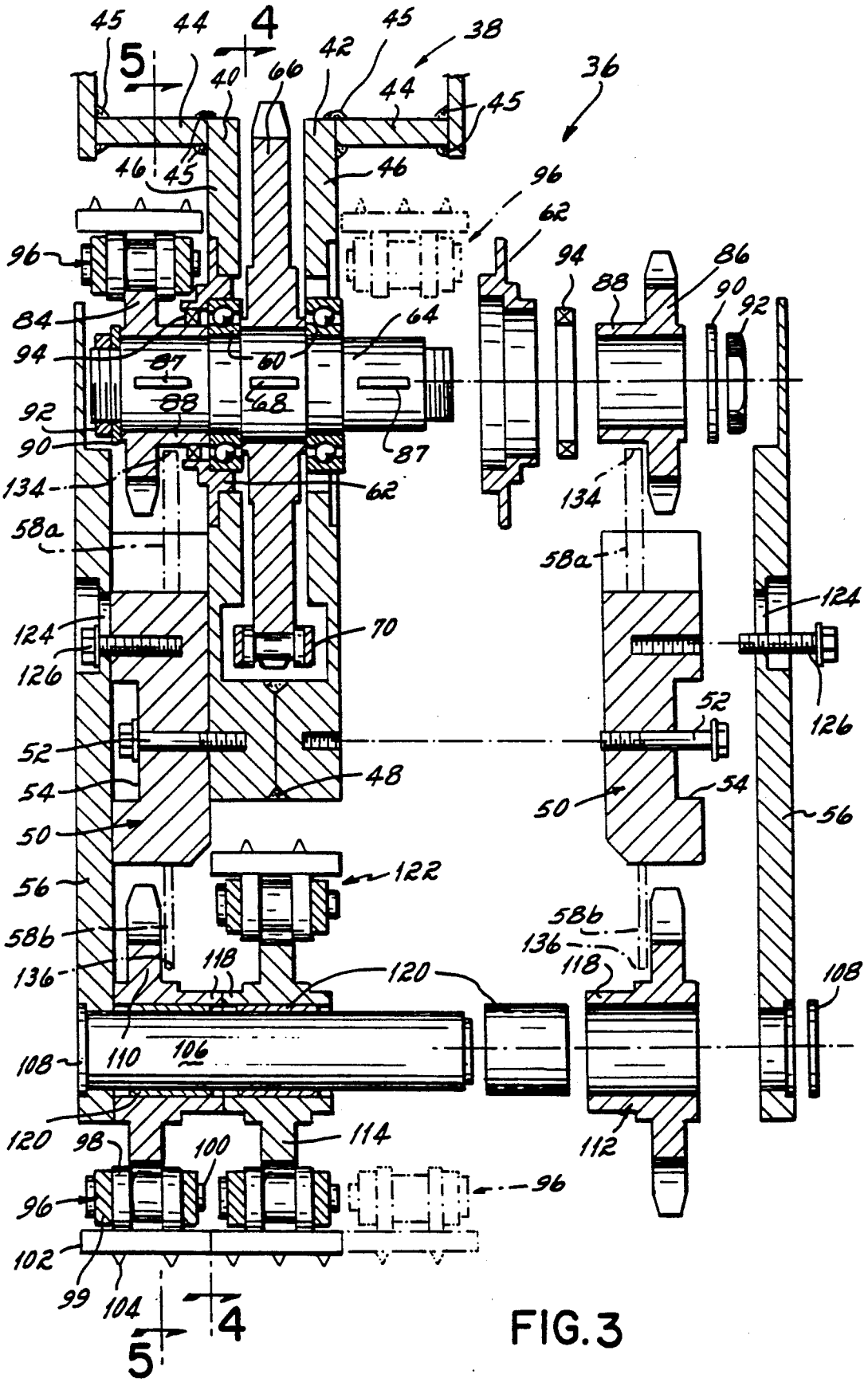
FIG. 3 is a cross sectional view of the digging and propulsion unit taken generally along lines 3—3 of FIG. 2, which is partially disassembled for purposes of illustration.
Figure 4:
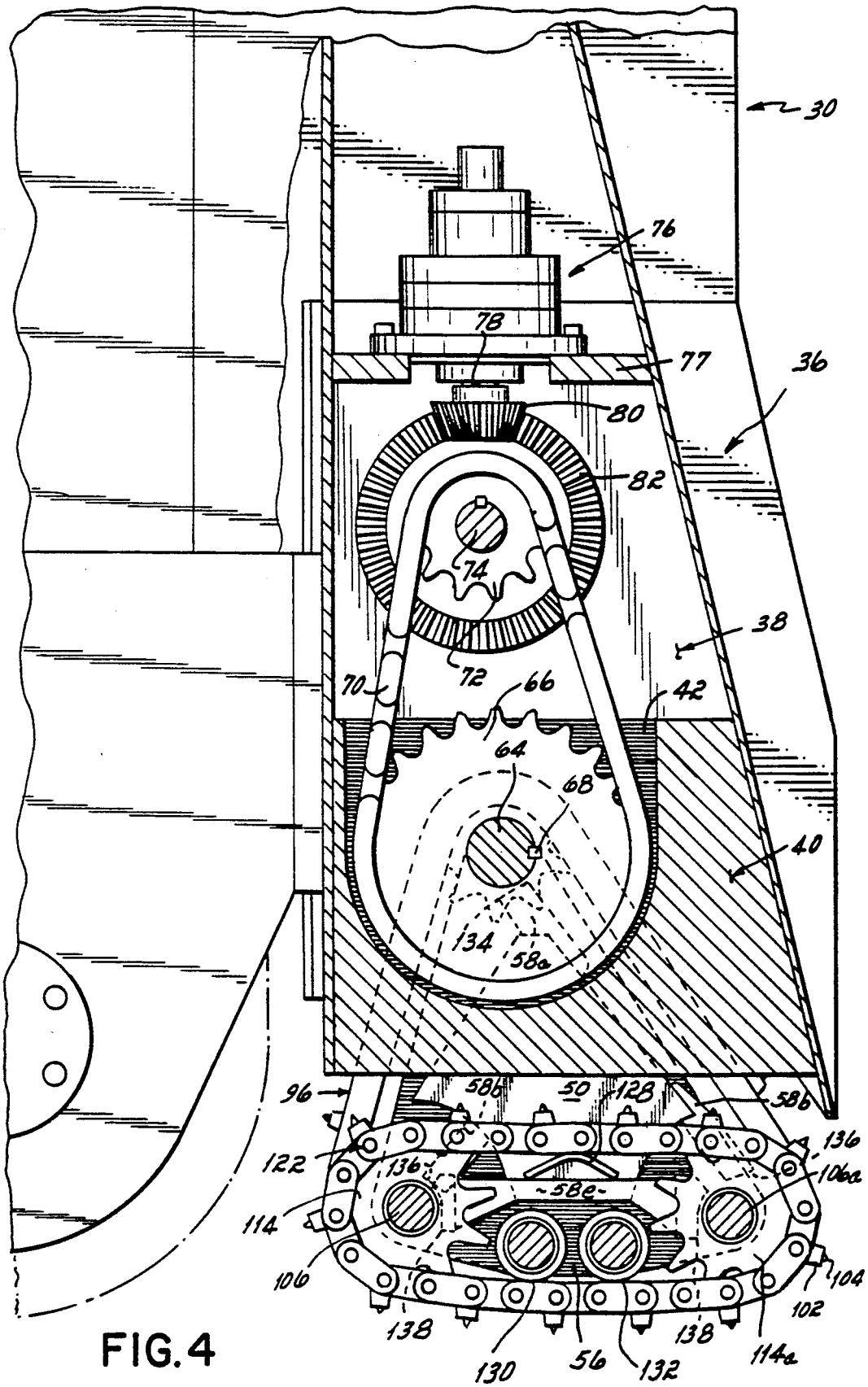
FIG. 4 is a view of the digging and propulsion unit, in partial cross section, taken generally along lines 4—4 of FIG. 3.

As best seen in FIGS. 3 and 4, the digging and propulsion unit 36 includes a frame 38 comprising side-by-side frame elements 40 and 42 which are essentially mirror images of one another. Each frame element 40, 42 includes an arcuate top plate 44 welded to the digger arm 30, as at weldments 45, and a vertical plate 46. The base of the vertical plates 46 of each frame element 40 and 42 are fixedly connected to one another such as by weldments 48. As viewed in FIG. 3, the digging and propulsion unit 36 is illustrated with one portion or side assembled and the other side disassembled so that the various structural elements are easier to visualize. For purposes of the present discussion, only one side of the digging and propulsion unit 36 is discussed in detail, it being understood that the opposite side is identical in construction and operation. The same reference numbers are utilized to indicate the same structure on both sides of the unit 36. Additionally, for purposes of discussion, the terms "upper" and "top" are meant to refer to the top of the unit 36 as viewed in FIGS. 2, 3 and 4, the terms "lower" and "bottom" refer to the opposite direction, the term "forward" refers to the lefthand side of the unit 36 as viewed in FIG. 4, and the term "rearward" refers to the righthand side of the unit 36.

Each of the vertical plates 46 of frame elements 40, 42 mounts a support plate 50 which is connected thereto by a number of bolts 52 received within a recess 54 formed in the support plate 50. As described in more detail below, the support plate 50 carries an adjustment plate 56 and a number of scrapers 58*a–e*.

As mentioned above, a principal function of the digging and propulsion unit 36 is to propel the lower end of digger arm 30 along the trench line. To accomplish this, the unit 36 includes a drive mechanism consisting of a series of sprockets and chains some of which include digger teeth engageable with the walls of the trench. With reference first to the upper portion of FIGS. 2 and 3, each of the vertical plates 46 is formed with a bore which receives a bearing 60 retained in place on the vertical plates 46 by a bearing retainer 62. The bearings 60 mount an upper shaft 64 which is rotatable within the bearings 60 by operation of a drive train best shown in FIG. 4. This drive train comprises a driven sprocket 66, connected to upper shaft 64 by a key 68, which, in turn, is drivingly connected by a drive chain 70 to a drive sprocket 72 carried on a shaft 74 journaled to frame 38. A drive motor 76, mounted on a bracket 77 to the digger arm frame 38, has an output shaft 78 which rotates a bevel gear 80 drivingly connected to a driven gear 82 mounted to shaft 74. In response to operation of motor 76, the gears 80, 82 rotate shaft 74, which, in turn, rotates the drive sprocket 72 and driven sprocket 66 via drive chain 70.

Because the upper shaft 64 is fixedly connected to driven sprocket 66, it rotates within bearings 60 with the driven sprocket 66. In turn, upper shaft 64 rotates a series of sprockets and chains associated with the digging and propulsion unit 36 to propel the digger arm 30 forwardly along a trench line. As depicted at the top of FIG. 3, the upper shaft 64 carries a first upper sprocket 84 and a second upper sprocket 86 located on either side of the driven sprocket 66. Each of the first and second upper sprockets 84, 86 includes a hub 88 keyed to the upper shaft 64 by a key 87 and retained thereon by a washer 90 and nut 92. Preferably, a hub bearing 94 is interposed between the sprocket hubs 88 and the bearing retainer 62 so that the sprockets 84, 86 are free to rotate with upper shaft 64 relative to the fixed bearing retainer 62.

Figure 7:
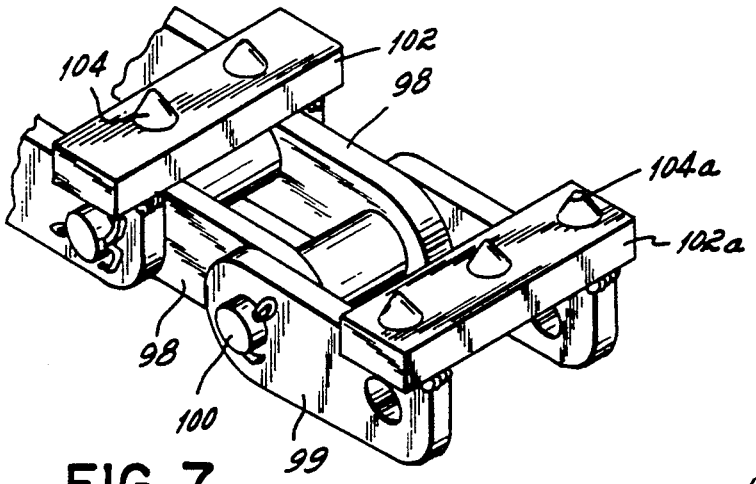
FIG. 7 is a perspective view of a portion of the improved digging chain used in the digging and propulsion unit of the present invention.

In the presently preferred embodiment, each of the first and second upper sprockets 84, 86 mounts an outer chain 96 whose inner links 98 and outer links 99 are pivotally interconnected at their ends by pivot pins 100. As viewed in FIG. 7, one end of each outer link 99 of chain 96 mounts a support plate 102 or 102*a* so that plates 102, 102*a* alternate along the length of endless chain 96. Each support plate 102 mounts two carbide traction/digger teeth or tips 104, and the support plates 102*a* mount three traction/digger tips 104*a*. As shown in FIG. 7, the tips 104 and 104*a* are staggered relative to one another on the support plates 102, 102*a*, respectively. These digger teeth 104, 104*a* are effective to engage the bottom wall of trench 31 as the outer chains 96 are rotated to improve the traction of digging a propulsion unit 36.

Figure 6:
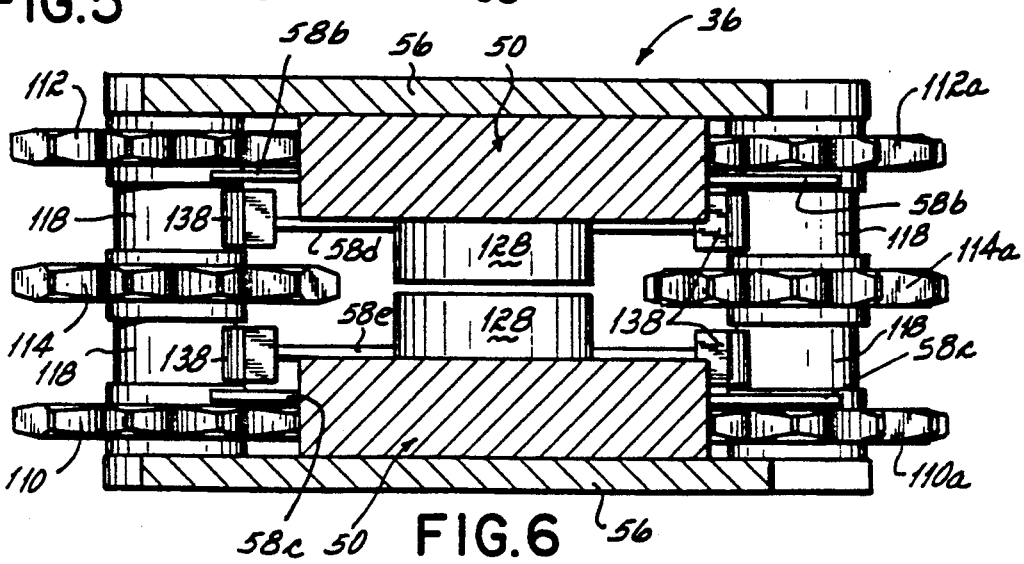
FIG. 6 is a cross sectional view of the lower end of the digging and propulsion unit taken generally along lines 6—6 of FIG. 5.

With reference to FIGS. 3, 4 and 6, the lower portion of digging and propulsion unit 36 includes a forward end and a rearward end which are spaced approximately equidistant from the upper shaft 64 and the first and second upper sprockets 84, 86. For purposes of the present discussion, the structure of the bottom portion of the forward end of digging and propulsion unit 36 is illustrated in detail, it being understood that the rearward end is structurally and functionally identical. As shown in FIG. 3, a forward lower shaft 106 extends between the bottom portion of the two adjustment plates 56 carried by frame 38 and is secured thereto by a pair of caps 108 each press-fit onto one end of the lower shaft 106. The forward lower shaft 106 mounts a first lower sprocket 110 in alignment with first upper sprocket 84, and a second lower sprocket 112 which aligns with the second upper sprocket 86. A forward, center sprocket 114 is interposed between the first and second lower sprockets 110, 112 along lower shaft 106. As noted above, and shown in FIGS. 4 and 6, the rearward end of the digging and propulsion unit 36 has the identical structure as the forward end including a rearward shaft 106*a* which mounts first and second lower sprockets 110*a*, 112*a* and a rearward center sprocket 114*a*. Each of the lower sprockets 110, 110*a*, 112, 112*a* and center sprockets 114, 114*a* have a hub 118 rotatably mounted by a sleeve bearing 120 to the lower shaft 106 or 106*a*. Preferably, the hub 118 of center sprocket 114 is fixed (by means not shown) to the hub 118 of one of the lower sprockets 110, 112, so that the center sprockets 114, 114*a* rotate therewith.

The outer chain 96 carried by first upper sprocket 84 extends about the first lower sprockets 110, 110*a*, a second outer chain 96 extends from second upper sprocket 86 around the second lower sprockets 112, 112*a*, and, a center chain 122 extends between the center sprockets 114, 114*a*. In response to rotation of the upper shaft 64 as described above the first and second upper sprockets 84, 86 are rotated, which, in turn, rotates the first and second lower sprockets 110, 112 on the forward shaft 106, and the first and second lower sprockets 110*a*, 112*a* on the rearward shaft 106*a*. Because the hub 118 of center sprockets 114 is fixedly connected to the hubs 118 of at least one of the first and second lower sprockets 110, 112, the center sprockets 114, 114*a* and their associated chain 122 are rotated on lower shafts 106, 106*a* with the first and second lower sprockets 110, 110*a* and 112, 112*a*. The lower run of both of the outer chains 96, and the center chain 122, contact a pair of idler rollers 130, 132 carried at each end by an adjustment plate 56. These rollers 130, 132 create a slight downward bow in chains 96, 122 which is advantageous in a number of respects. First, the downwardly bowed or curved of chains 96 and 122 provides improved penetration capability as the digger and propulsion unit 36 initially digs downwardly to the desired trench depth. Once the unit 36 has reached the desired trench depth, it is not always possible to maintain the digger arm 30 perfectly vertical, i.e., the digger arm 30 may tilt forwardly or rearwardly relative to the direction of movement along the trench line. The curved or bowed profile of chains 96 and 122 is effective to ensure that the appropriate percentage of the digger teeth 104, 104*a* thereof remain in contact with the bottom wall of the trench 31 throughout the trenching operation. A further advantage of providing the chains 96 and 122 with a downward curve or bow is that it allows the digger and propulsion unit 36 to "climb" over debris being formed by the digger arm 30 in the course of digging the trench 31. This debris or spoil, e.g., dirt, stone, clay, sand, etc., tends to pile up in front of the unit 36, and the downward curve or bow of chains 96 and 122 prevents such debris from impeding the forward progress of the unit 36 as it moves along the base of the trench 31.

The effectiveness of the digging and propulsion unit 36 in initially digging downwardly to the desired trench depth, and thereafter propelling the lower end of digger arm 30, is dependent to a large extent on maintaining the appropriate tension of the two outer chains 96 and the center chain 122. After a period of time, a certain degree of wear of these chains is unavoidable and the tension of such chains between their associated sprockets is lessened. An important aspect of this invention is the provision of structure for quickly and efficiently tensioning chains 96 and 122 as they become loosened.

With reference to FIGS. 2 and 3, each of the adjustment plates 56 is formed with a number of vertically oriented slots 124 each of which receives an adjustment screw 126 threaded into a support plate 50. As discussed above, these support plates 50 are held in a fixed vertical position by virtue of their connection to the vertical frame elements 40 and 42. In order to adjust the tension on the two outer chains 90, the adjustment screws 126 are each loosened and the adjustment plates 56 are moved downwardly along the slots 124 therein. Because the forward and rearward lower shafts 106, 106*a* are fixed to the adjustment plates 56, such shafts 106, 106*a* move downwardly therewith. In turn, the outer chain 96 looped around the first lower sprockets 110, 110*a* and the second outer chain 96 looped around the second lower sprockets 112, 112*a* are tightened or tensioned because the relative distance or spacing between the upper shaft 64 and lower shafts 106, 106*a* is slightly increased. The adjustment screws 126 are then tightened down with the adjustment plates 56 in a lowered position so that the trenching operation can proceed.

Figure 5:
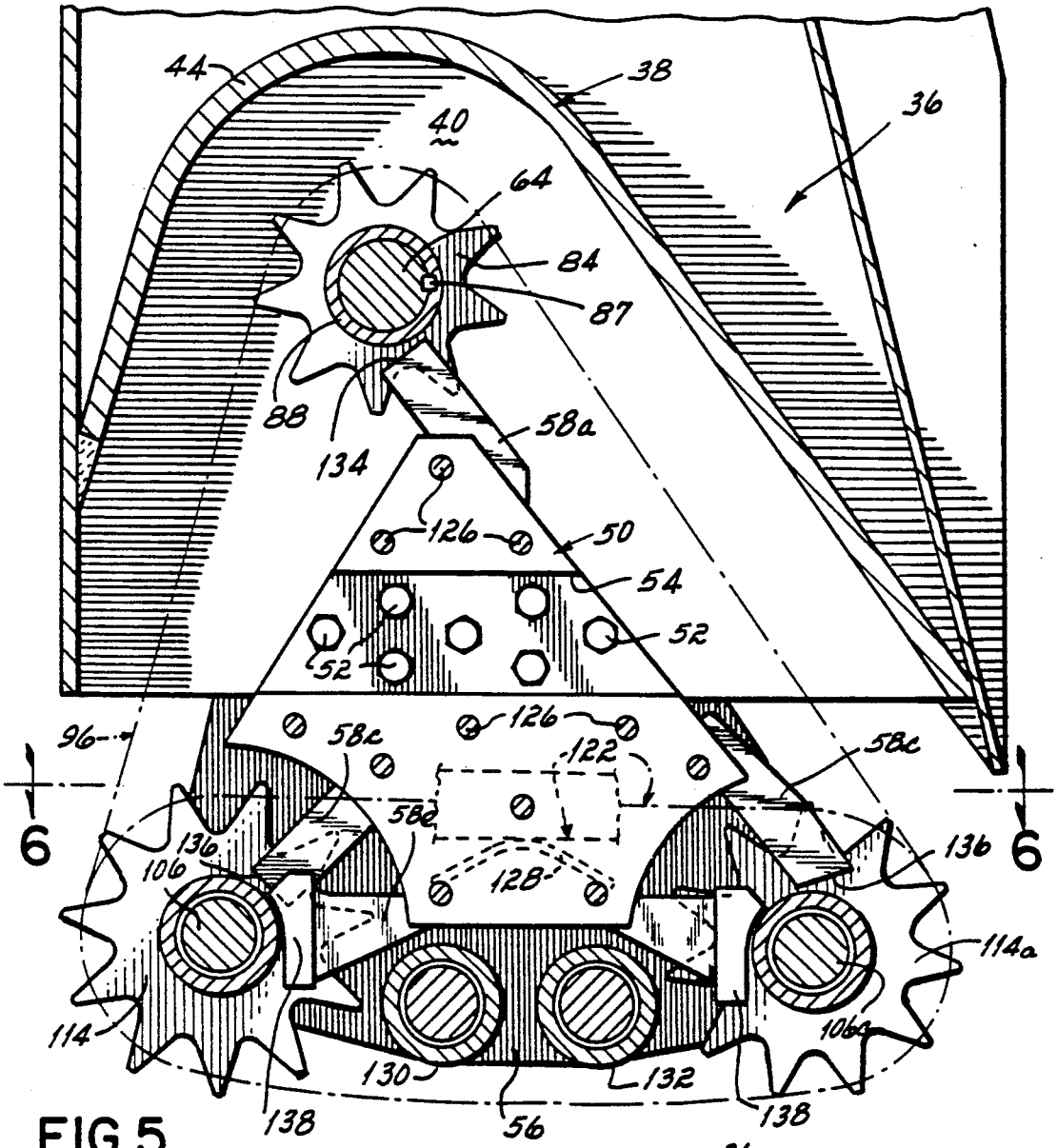
FIG. 5 is a cross sectional view of the digging and propulsion unit taken generally along lines 5—5 of FIG. 4.

The tension on center chain 122 is substantially maintained by operation of a tension plate 128. As best shown in FIGS. 4–6, each of the support plates 50 mounts an inverted, U-shaped tension plate 128 in position to engage the upper run of the center chain 122. When the forward and rearward lower shafts 106, 106*a* are lowered, as described above, the center sprockets 122, 122*a* also move downwardly but the tension plate 128 remains in the same vertical position on the support plates 50 and contacts the upper run of center chain 122. As a result, the center chain 122 is tensioned to substantially the same extent as the outer chains 96, 96*a*.

In another aspect of this invention, it is recognized that the effectiveness of the above-described drive train in propelling the digging and propulsion unit 36 along the trench line is dependent at least to some extent on maintaining the Various sprockets and chains substantially free of foreign material such as dirt, clay, concrete, sand, rocks and the like. If any of the first and second upper sprockets 84, 86, first and second lower sprockets 110, 110*a*, 112, 112*a* and/or the center sprockets 114, 114*a* become covered or impacted with foreign material, it can affect the operation of unit 36.

With reference to FIGS. 5 and 6, the scrapers 58*a–e* mentioned above are illustrated in detail. In the presently preferred embodiment, an upper scraper blade 58*a* is mounted to each support plate 50 so that its leading edge 134 is located proximate the empty teeth and hub 88 of one of the first and second upper sprockets 84, 86. See also FIG. 3 (phantom lines). These two upper scraper blades 58*a* are effective to remove dirt and other foreign material from the area of the first and second upper sprockets 84, 86 to ensure that they are free to receive the chains 96 and can freely rotate with upper shaft 64. Similar structure is provide for each of the first and second lower sprockets 110, 112 on the forward lower shaft 106 and for first and second lower sprockets 110*a*, 112*a* on the rearward lower shaft 106*a*. As viewed in FIG. 6, a pair of outer scrapers 58*b* and 58*c* are mounted to the support plates 50 so that their leading edges 136 are located proximate the empty teeth and the hubs 118 of first and second lower sprockets 110, 110*a*, and 112, 112*a*, respectively. Additionally, inner scraper blades 58*d* and 58*e* are carried by support plates 50 so that a scraper tip 138 mounted thereon is located immediately adjacent the hubs 118 of sprockets 110, 110*a*, 114, 114*a*, 112 and 112*a* carried by the forward lower shaft 106 and the rearward lower shaft 106*a*. The scraper blades 58*a–e* are effective to maintain the sprockets 84, 86, 110, 110*a*, 112, 112*a*, 114, 114*a*, and the space therebetween, substantially free of debris or other foreign material so that it does not interfere with the operation of digging and propulsion unit 36.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. Apparatus for digging a trench, comprising:

a base support movable along a trench line;

a digger arm having an upper end connected to said base support, and a lower end;

a digger and propulsion unit connected to said lower end of said digger arm, said digger and propulsion unit including:

(i) a frame carried by said digger arm;

(ii) a first sprocket rotatably mounted to said frame;

(iii) a first shaft spaced from said first sprocket, said first shaft mounting a second sprocket;

(iv) a first endless chain extending between said first and second sprockets (v) adjustment means for adjusting the relative spacing between said first sprocket and said second sprocket to vary the operating tension of said first endless chain extending therebetween;

said digger arm and said digger and propulsion unit cooperating to initially dig downwardly from ground level to a desired trenching depth, and thereafter move along said trench line to dig a trench.

2. The apparatus of claim 1 in which said adjustment means comprises:

a first support connected to one end of said first shaft, and a second support connected to the opposite end of said first shaft;

means for securing each of said first and second supports to said frame at different positions relative to said first sprocket.

3. The apparatus of claim 2 in which each of said first and second supports is an adjustment plate attached at one end of said shaft, each of said adjustment plates being formed with a number of vertical slots which receive fasteners engageable with said frame.

4. The apparatus of claim 1 in which said first endless chain comprises:

a plurality of chain links pivotally connected to one another;

a mounting plate connected to at least every other one of said chain links, each of said mounting plates carrying conical teeth extending therefrom, said teeth on one mounting plate being staggered with respect to the teeth on an adjacent mounting plate.

5. Apparatus for digging a trench, comprising:

a base support movable along a trench line;

a digger arm having an upper end connected to said base support, and a lower end;

a digger and propulsion unit connected to said lower end of said digger arm, said digger and propulsion unit including:

(i) a frame carried by said digger arm, said frame having a forward end and a rearward end;

(ii) an upper shaft carried by said frame, said upper shaft mounting a driven sprocket and first and second upper sprockets;

(iii) a forward shaft and a rearward shaft carried at said forward and rearward ends of said frame, respectively, and spaced below said upper shaft, said forward and rearward shafts each mounting a first lower sprocket and a second lower sprocket;

(iv) a first endless chain extending between said first upper sprocket and said first lower sprockets, and a second endless chain extending between said second upper sprocket and said second lower sprockets;

(v) adjustment means for adjusting the relative spacing between said upper shaft and said first and second lower shafts to vary the tension of said first and second chains extending between said upper sprocket and said lower sprockets;

said digger arm and said digger and propulsion unit cooperating to initially dig downwardly from ground level to a desired trenching depth, and thereafter propel said digger arm along said trench line to dig a trench.

6. The apparatus of claim 5 in which said adjustment means comprises;

a first support connected to one end of each of said forward and rearward shafts, and a second support connected to the other end of each of said forward and rearward shafts;

means for securing each of said first and second supports to said frame at different positions relative to said upper sprocket.

7. The apparatus of claim 6 in which each of said first and second supports is an adjustment plate attached at opposite ends of said forward and rearward shafts, each of said adjustment plates being formed with a number of vertical slots which receive fasteners engageable with said frame, said fasteners being loosened to permit downward movement of said supports and said forward and rearward shafts relative to said upper shaft to tension said first and second chains.

8. The apparatus of claim 7 in which said digger and propulsion unit further comprises a third lower sprocket mounted to each of said forward and rearward shafts between said first and second lower sprockets carried thereon, and a third endless chain extending between said third lower sprockets.

9. The apparatus of claim 8 in which said digger and propulsion unit further includes means for adjusting the tension of said third chain, said means including a tension bar mounted to said frame in position to engage an upper run of said third chain, said third lower sprockets being movable downwardly with said forward and rearward shafts while said tension bar remains fixed to thereby tension said third chain as said first and second chains are tensioned.

10. The apparatus of claim 5 in which each of said first and second endless chain comprises:

a plurality of chain links pivotally connected to one another;

a mounting plate connected to at least every other one of said chain links, each of said mounting plates carrying conical teeth extending therefrom, said teeth on one mounting plate being staggered with respect to the teeth on an adjacent mounting plate.

11. Apparatus for digging a trench, comprising:

a base support moveable along a trench line;

a digger arm having an upper end connected to said base support and a lower end;

a digger and propulsion unit connected to said lower end of said digger arm, said digger and propulsion unit including:

(i) a frame carried by said digger arm;

(ii) a first sprocket having a hub, said first sprocket being rotatably mounted to said frame;

(iii) a first shaft spaced from said first sprocket, said first shaft mounting a second sprocket having a hub;

(iv) a first endless chain extending between said first and second sprockets;

(v) scraper means for clearing debris from at least one of said first and second sprockets as said first endless chain travels therebetween, said scraper means including an edge locate proximate the hub of at least one of said first and second sprockets;

said digger arm and said digger and propulsion unit cooperating to initially dig downwardly from ground level to a desired trenching depth, and thereafter over along said trench line to dig a trench.

12. The apparatus of claim 11 in which said scraper means comprises:

a first scraper arm having first and second ends, said first scraper arm being located adjacent at least one side of one of said first and second sprockets, said first end of said first scraper arm being mounted to said frame, and said second end of said first scraper arm having an edge located proximate the hub of one of said first and second sprockets.

13. Apparatus for digging a trench, comprising:

a base support movable along a trench line;

a digger arm having an upper end connected to said base support, and a lower end;

a digger and propulsion unit connected to said lower end of said digger arm, said digger and propulsion unit including:

(i) a frame carried by said digger arm, said frame having a forward end and a rearward end;

(ii) an upper shaft carried by said frame, said upper shaft mounting a driven sprocket and first and second upper sprockets;

(iii) a forward shaft and a rearward shaft carried at said forward and rearward ends of said frame, respectively, and spaced below said upper shaft, said forward and rearward shafts each mounting a first lower sprocket and a second lower sprocket;

(iv) a first endless chain extending between said first upper sprocket and said first lower sprockets, and a second endless chain extending between said second upper sprocket and said second lower sprockets;

(v) adjustment means for adjusting the relative spacing between said upper shaft and said first and second lower shafts to vary the tension of said first and second chains extending between said upper sprocket and said lower sprockets;

(vi) scraper means for clearing debris from said first and second upper sprockets, and from said first and second lower sprockets;

said digger arm and said digger and propulsion unit cooperating to initially dig downwardly from ground level to a desired trenching depth, and thereafter propel said digger arm along said trench line to dig a trench.

14. The apparatus of claim 13 in which said adjustment means comprises;

a first support connected to one end of each of said forward and rearward shafts, and a second support connected to the other end of each of said forward and rearward shafts;

means for securing each of said first and second supports to said frame at different positions relative to said upper sprocket.

15. The apparatus of claim 14 in which each of said first and second supports is an adjustment plate attached at opposite ends of said forward and rearward shafts, each of said adjustment plates being formed with a number of vertical slots which receive fasteners engageable with said frame, said fasteners being loosened to permit downward movement of said supports and said forward and rearward shafts relative to said upper shaft to tension said first and second chains.

16. The apparatus of claim 15 in which said digger and propulsion unit further comprises a third lower sprocket mounted to each of said forward and rearward shafts between said first and second lower sprockets carried thereon, and a third endless chain extending between said third lower sprockets.

17. The apparatus of claim 16 in which said digger and propulsion unit further includes means for adjusting the tension of said third chain, said means including a tension bar mounted to said frame in position to engage an upper run of said third chain, said third lower sprockets being movable downwardly with said forward and rearward shafts while said tension bar remains fixed to thereby tension said third chain as said first and second chains are tensioned.

18. The apparatus of claim 13 in which each of said first and second endless chain comprises:

a plurality of chain links pivotally connected to one another;

a mounting plate connected to at least every other one of said chain links, each of said mounting plates carrying conical teeth extending therefrom, said teeth on one mounting plate being staggered with respect to the teeth on an adjacent mounting plate.

19. The apparatus of claim 13 in which said scraper means comprises:

a pair of first scraper arms each connected at one end to said frame, the other end of each said first scraper arms being located proximate one of said first and second upper sprockets;

a pair of second scraper arms each connected at one end to said frame, the other end of each said second scraper arms being located proximate one of said first and second lower sprockets carried on said forward shaft;

a pair of third scraper arms each connected at one end to said frame, the other end of each said third scraper arms being located proximate one of said first and second lower sprockets carried on said rearward shaft.

20. Apparatus for digging a trench, comprising:

a base support moveable along a trench line;

a digger arm having an upper end connected to said base support, and a lower end;

a digger and propulsion unit connected to said lower end of said digger arm, said digger and propulsion unit including:

(i) a frame carried by said digger arm, said frame having a forward end and a rearward end;

(ii) an upper shaft carried by said frame, said upper shaft mounting a driven sprocket and first and second upper sprockets;

(iii) a forward shaft and a rearward shaft carried at said forward and rearward ends of said frame, respectively, and spaced below said upper shaft, said forward and rearward shafts each mounting a first lower sprocket and a second lower sprocket;

(iv) a first endless chain extending between said first upper sprocket and said first lower sprockets, and a second endless chain extending between said second upper sprocket and said second lower sprockets;

(v) means for creating a downward bow along at least a portion of the lower run of said first and second endless chains;

said digger arm and said digger propulsion unit cooperating to initially dig downwardly from ground level to a desired trenching depth, and thereafter move along said trench line to dig a trench.

21. The apparatus of claim 20 in which said means for creating a downward bow comprises at least one idler roller mounted to said frame of said digger and propulsion unit in position to engage said first and second chains along the lower run thereof so that said first and second chains are bowed downwardly relative to said first and second lower sprockets.

* * * * *